US011626089B2

(12) United States Patent
Humal

(10) Patent No.: US 11,626,089 B2
(45) Date of Patent: Apr. 11, 2023

(54) METHOD FOR TUNING A PIPE ORGAN AND A REED PIPE TUNING DEVICE

(71) Applicant: Priit Humal, Tartu (EE)

(72) Inventor: Priit Humal, Tartu (EE)

( * ) Notice: Subject to any disclaimer, the term of this patent is extended or adjusted under 35 U.S.C. 154(b) by 13 days.

(21) Appl. No.: 17/643,025

(22) Filed: Dec. 7, 2021

(65) Prior Publication Data

US 2022/0180844 A1 Jun. 9, 2022

(30) Foreign Application Priority Data

Dec. 8, 2020 (EP) ..... 20020595

(51) Int. Cl.
*G10B 3/00* (2019.01)
*G10B 1/02* (2006.01)

(52) U.S. Cl.
CPC *G10B 3/00* (2013.01); *G10B 1/02* (2013.01)

(58) Field of Classification Search
CPC ..... G10B 3/00; G10B 1/02
See application file for complete search history.

(56) References Cited

U.S. PATENT DOCUMENTS 1,059,365 A * 4/1913 Hope-Jones ..... G10B 3/08 84/350
1,690,381 A * 11/1928 Teetor ..... G10B 3/08 984/11
2022/0180844 A1* 6/2022 Humal ..... G10B 3/00

FOREIGN PATENT DOCUMENTS

DE 2622523 A * 12/1977 ..... G10B 1/08
EP 2933794 A2 * 10/2015 ..... G10B 3/08
EP 3316249 A1 * 5/2018 ..... G10B 3/08

* cited by examiner

*Primary Examiner* — Robert W Horn

(57) ABSTRACT

The invention provides a method, system and tuning devices for reed and flue pipes for automatically tuning or checking the tuning of a pipe organ. The invention enables the tuning of the reed pipes to the same pitch as flue pipes if the fluctuation of temperature and humidity has caused a change in the pitch of the flue pipes, and to restore the tuning of the reed pipes in case of random loss of tuning. The invention allows to reduce the tuning time and to tune the pipes that require more frequent tuning (i.e. the reed pipes) unobtrusively to the organist and listeners during the playing of the organ. It is possible to employ the method of the invention on all pipes of an organ or only on a selection of them.

13 Claims, 7 Drawing Sheets

METHOD FOR TUNING A PIPE ORGAN AND A REED PIPE TUNING DEVICE

TECHNICAL FIELD

The present invention belongs to the field of tuning of musical instruments, more specifically it represents methods and devices for tuning pipe organs.

BACKGROUND OF THE INVENTION

The tuning of musical instruments is an important part of their use. The tuning of a large musical instrument like the pipe organ is a regular, labor-intensive, and time-consuming task for the musician or trained personnel. The organ is comprised of single pipes, the number of which varies from one hundred to ten thousand.

Based on how they produce a tone, the organ pipes are divided into two types: flue pipes (also referred to as labial pipes); and reed pipes. The vast majority of the organ pipes are flue pipes and many organs even do not contain reed pipes. The sound of flue pipes is produced in the immobile lip of the flue pipe by the uneven flow of resonating air. The oscillation frequency of the sound waves directly depends on the length of the flue pipe. To tune a flue pipe, the length of the pipe is changed using special instruments or, for example, the solution proposed by patent application DE102012021644A1 (Markus Voigt, 2012), where the tuning element located on the tuning slot at the upper end of the resonator is moved with an electric motor.

In reed pipes, the oscillation is caused by the metal strip, or tongue, located at the bottom end of the pipe, which, as it vibrates, periodically allows or blocks the airflow into the pipe. The oscillation frequency, or pitch, of such a pipe depends of the length of the vibrating part in addition to the resonator. For tuning, the length of the vibrating part can be changed with a movable tuning wire. The moving of the tuning wire does not require much force and can occur spontaneously. This random loss of tuning, the cause for the need to periodically retune, concerns more often the reed pipes of a pipe organ. They need to be tuned at least once a week and it is also recommended to check the tuning and if necessary, retune before a concert. The tuning of reed pipes and checking their tuning takes from half an hour to several hours depending on the size of the organ.

Checking the tuning of all flue pipes normally takes from one day to several months depending on the size of the organ. Spontaneous (random) detuning of flue pipes is much slower than that of reed pipes and their tuning is usually done once a year.

In addition to the random loss of tuning described above, tuning changes also occur in a pipe organ due to fluctuation of temperature and humidity. The pitch of flue pipes depends, besides the length of the flue pipe, also on the speed of sound in air. The latter in turn depends on temperature. Therefore, a change in room temperature notably affects the tuning of flue pipes. Even a fluctuation of a few centigrade changes remarkably the pitch flue pipes. Every pipe has a certain deviation measured in Cents from its note standard frequency. Said notes standard frequencies form a chromatic scale that corresponds to organ intended temperament (equal-tempered, Werckmeister etc.). The pitch changes are similar for all flue pipes, their deviation from note standard frequency changes equally, and therefore the flue pipes will remain in consonance with each other even at different absolute frequencies. However, the problem arises with reed pipes, whose pitch is not affected by temperature in the same way as for flue pipes. Following a temperature fluctuation, reed pipes and flue pipes are no longer on the same relative pitch. As there are less reed pipes and their tuning is easier than flue pipes tuning, the flue pipes are not restored to their former pitch, but the reed pipes are manually tuned to the new pitch that has the same deviation as the flue pipes have reached due to temperature change.

Beat tunes audible to the ear between close frequencies are usually used to tune a pipe organ, making two pipes, separated by an interval of a prime or an octave, sound simultaneously. The goal is to apply the manual tuning tools until there are no more beats. At recent time, electronic frequency measuring devices equipped with microphones are also used at tuning.

Similarly to reed stops, whose pitch is less affected by temperature, digital musical instruments intended to be used simultaneously with flue pipes also need to be adjusted according to the flue pipes of the pipe organ. A solution has been disclosed in the patent EP1941488B1 (Rolando Luciani, 2006) as a method for obtaining frequency adjustment parameter for digital instruments via different options: to calculate from room temperature deviation or to measure the pitch of the flue pipes. This patent also offers the method of selectively measuring the sound of particular flue pipe, undisturbed by adjacent pipes and background noise, suggesting to use microphone installed at a short distance from the pipe to be monitored, or by a contact microphone or a piezoceramic buzzer, directly mounted against the metal surface of the pipe, or by an air flow sensor installed in appropriate position.

It is often difficult to execute the tuning as the section where the tuning should be performed is remote from the playing console. To solve this problem, the patent application DE2622523A1 (Ernst Zacharias, 1976) proposes equipping the tuning wires with motors that the tuner could control from the console.

A device to semi-automatically tune the reed stops of a pipe organ, equipped with a microcontroller and a microphone in addition to motors that can move the tuning wires, is proposed in the patent EP3316249B1 (Clemens Sulz, 2017). The latter is the closest prototype to the solution provided by the present invention. The invention proposes a solution for tuning several pipes simultaneously by using band pass filters between microphone and the frequency meter to reduce tuning time.

The U.S. Pat. No. 6,559,369B1 (Donald A. Gilmore, 2002) describes a method of tuning a piano by independently and simultaneously measuring the oscillation of the strings while automatically tuning them, where the oscillation of the strings is detected by the electromagnetic method. Detecting the oscillation with infrared light has also been used on pianos, see https://newatlas.com/gilmore-self-tuning-piano-system/21425/(Published on 12 Feb. 2012) [retrieved on 7 Dec. 2020].

There is a research publication about stationary spectra of not only sound waves generated by different organ pipes, but also of the pipes wall vibration. (Angster, J.; Rucz, P.; Miklos, A.: Acoustics of Organ Pipes and Future Trends in the Research. Acoustics Today. 13(1), 2017, FIG. 7. Online: https://acousticstoday.org/wp-content/uploads/2017/01/Acoustics-of-Organ-Pipes-and-Future-Trends-in-the-Research-Judit-Angster-tpdf) [retrieved on 7 Dec. 2020].

Shortcomings of Known Solutions

There are several problems unsolved so far. There is no pipe organ tuning device that could determine by itself which particular reed pipe is sounding and, consequently, engage the corresponding reed pipe tuning mechanism.

There is no method of checking the tuning of the flue pipes of a pipe organ and (self)tuning of the reed pipes without any separate tuning procedure, but conducted by the tuning system during the regular playing on the organ. The known devices for pipe organ tuning that measure the tuning, using microphones, regardless distinguishing simultaneously sounding pipes with a band pass filter, cannot accurately identify which pipe is sounding, as a pipe organ typically has several pipes with the same pitch in different stops. Furthermore, an actuator with a motor for tuning reed pipes requires separate anchorage points on the casing and on the tuning wire of a pipe; dependent on the construction of a reed pipe, it might be somewhat difficult to install it.

Thus, there is a need for a solution for an automatically tuning the pipes of a pipe organ unnoticeably during regular play of the organ, that is capable to determine selectively, which pipe is being sounded, and to get reliable measurements of the pipes' frequency, undisturbed by the neighboring sounding pipes.

SUMMARY OF THE INVENTION

The purpose of the invention is to reduce the time of the user (tuner or organist) consumed to tune the pipe organ and to tune the pipes that require more frequent tuning (the reed pipes) unobtrusively to the organist and listeners. It is possible to employ the method of the invention on all pipes of an organ or only on a certain selection of them. The invention provides the tuning system, the tuning device for reed pipes, and the tuning device for flue pipes that can be used to implement the method proposed by the invention. The invention enables—unobtrusively to the listeners during the playing of the pipe organ—the tuning of the reed pipes to the same pitch as flue pipes if the fluctuation of temperature and humidity has caused a change in the pitch of the flue pipes of the pipe organ, and to restore the tuning of the reed pipes of the pipe organ in case of random loss of tuning.

Pitch of the pipe is directly related to the fundamental frequency of the sound oscillation produced by the organ pipe (either reed pipe or flue pipe) simultaneously with sounding organ pipe itself vibrates on the same fundamental frequency of the (reed or flue) pipe. Occurrence of said vibration, detected by an accelerometer, is used in the invention to determine pipes sounding status—pipe is sounding or not sounding. To avoid false positive determination of the pipe sounding status, the vibration noise from blower or from neighboring pipes must be filtered out. Although organ has many pipes that have the same fundamental frequency, vibration of every pipe has its unique spectral envelope of harmonics. Furthermore, modern accelerometers are capable of measuring the vibration selectively in the three perpendicular axes, thus providing even more unique data pattern for filtering noise and selectively determine sounding status of the particular pipe, by matching measured harmonic amplitudes of the pipe vibration in three axes with stored unique values for the pipe. In the case that predetermined number of measured amplitudes are within predetermined range with the stored values, the vibration is considered as matching and the pipe sounding status determined as positive.

The present invention offers organ pipe tuning devices, that are characterized, by using accelerometers for sounding detection and by specific mounting and actuator means.

The present invention requires, for the tuning of a pipe organ, at least one independently operating reed pipe tuning device or preferably several connected reed pipe tuning devices, that collectively compose the tuning system of a pipe organ. The tuning system can also include some flue pipe tuning devices in addition to reed pipe tuning devices.

The objects of the invention are the method for tuning a pipe organ, the tuning system of the pipe organ, the reed pipe tuning device of the pipe organ, and the flue pipe tuning device of the pipe organ. The turning system and tuning devices can also be used for conducting some different tuning procedures than the one the method of the invention offers.

Method

A method for tuning the pipe organ is offered, which comprises the following installation and working steps:

a) The tuning devices are permanently attached to the organ pipes that are chosen to be tuned by the tuning system (200). In case of reed pipes, to the tuning wire of every reed pipes is attached a reed pipes tuning device. The tuning devices comprise of an accelerometer, and a microcontroller, and in addition in the case of reed pipes, a tuning mechanism capable of moving the tuning wire, which changes the pitch of the reed pipe.

b) During the setup of every reed pipe tuning device the value of the desired vibration frequency and its amplitude characteristics are stored in the tuning device (201).

Once the previous steps a and b have been performed for all pipes that are to be tuned, the tuning system is ready to automatically tune the organ pipes through steps c-f:

c) The user when playing the organ regularly starts to sound different pipes (202).

d) Waiting for the vibration in the reed pipe to which tuning device is attached until the user of the organ makes this particular pipe to sound. By using the accelerometer and processing the accelerometer readings by the microcontroller of reed pipe tuning device, repeatedly detecting whether there is a vibration in the reed pipe, to which the tuning device is attached, that matches to the vibration stored in step b (203). Every reed pipe tuning device repeatedly detects matching vibration of the pipe by comparing measured amplitudes of frequency components of the vibration with the values stored in step b, until it is positively determined that the reed pipe to which it is mechanically connected has started to sound and vibrate. The microcontroller measures the fundamental vibration frequency of the reed pipe (205).

e) The microcontroller compares the value of measured fundamental vibration frequency of the reed pipe against the value of desired vibration frequency (206) and in case of a difference (at least 1 Cent), the microcontroller engages the tuning mechanism (207), which moves the tuning wire of the reed pipe. Moving the tuning wire changes the vibration frequency of the reed pipe. The microcontroller engages the tuning mechanism to move the tuning wire in the direction and to the necessary extent, as calculated, to achieve the desired vibration frequency.

During the use (tuning or playing) of the organ, steps c-f are repeated continuously and automatically. In case all the reed pipes to which the reed pipe tuning device is attached have sounded and the difference of the measured vibration fundamental frequency of every reed pipe and the desired vibration frequency is less than 1 Cent, the organ reed pipes are in tune (219). Corresponding message will be sent to the operator (220).

The method can be used in the case of pipe organs that are constantly kept at the same temperature or close to it and whose flue pipes, consequently, stay on the same pitch. In this case, the reed pipe tuning device, according to the method proposed by the invention and described above, only corrects the random changes in the pitch of reed pipes automatically and unobtrusively to the user (organist) and listeners.

Room Temperature Change Compensation

The automatic tuning according to the method described above can also be used on pipe organs that are located in a room with fluctuating temperature. However, as the surrounding conditions change, the pitch of the flue pipes changes and it is required to store the value of new desired vibration frequency into the reed pipe tuning devices, to be adjusted according to the changed pitch of the flue pipes.

The invention offers two options how to automatically actualize the value of desired vibration frequency of the reed pipes: the direct and the indirect. In the case of the indirect approach, in step b, together with the desired vibration frequency of the reed pipe, the current room temperature (and humidity) are stored (208).

In step d, the room temperature (and humidity) are measured, and the value of actual desired vibration frequency, which will be used as the value of the desired vibration frequency in step f, is calculated as the function of the value of stored desired vibration frequency of the reed pipe and the change of room temperature and/or humidity (209).

The advantage of the above indirect approach (calculating the change of the frequency of flue pipes) is the autonomy of every reed pipe tuning device: the temperature and/or humidity sensor can be placed on the tuning device. It only needs an electric power supply and there is no need for a data communication with other tuning devices installed on the pipe organ. As the temperature rises, so does the vibration frequency. According to the easiest calculation, the vibration frequency value is adjusted by 2.9 Cents per centigrade and by 0.06 Cents per percent of humidity, if it is measured. Obviously, the humidity change has less effect and it can be ignored. According to the temperature and humidity difference between the values stored in step b and measured in step d, and the value of desired vibration frequency stored in step b, the estimated frequency that has shifted due to changes in environmental conditions is calculated and used as actual value of desired reed pipe vibration frequency (210). This calculated frequency is used in step e as the value of the actual desired vibration frequency. Through that, the reed pipes are tuned to the same deviation from a note standard frequency as the flue pipes have been shifted due to the changes in room temperature (and humidity).

In the case of the direct approach of actualizing the value of desired vibration frequency of the reed pipe due to changed room temperature (and humidity), the change of the vibration frequency of flue pipes is measured from the flue pipes of the pipe organ and the following additional actions are taken in steps a, b, d, and e.

In step a, one or more flue pipe tuning device(s) containing accelerometer(s) (211) is/are placed in touch contact to one or more flue pipes. Said flue pipe tuning device(s) is/are connected by means of the data transmission network to at least one, but normally to all reed pipe tuning devices that will use the value of actual desired reed pipe vibration frequency.

In step b, during the setup at least one frequency and amplitude, characterizing the vibration of the sounding flue pipe, is stored.

As the user of the organ makes the flue pipes sound (202), the occurrence of vibration in flue pipes is repeatedly detected in step d (212) using accelerometer and the microcontroller of the flue pipe tuning device. Every flue pipe tuning device repeatedly detects matching vibration of the pipe by comparing measured amplitude and frequency of the vibration with the values stored in step b (212), until it is positively determined that the flue pipe, to which it is mechanically connected, has started to sound and vibrate. The fundamental vibration frequency of the flue pipe is measured (213) and the relative deviation from the nearest note standard frequency in Cents is calculated (214). If several flue pipes are in contact with flue pipe tuning devices, all deviations are saved to the database and the median of all relative deviations is calculated.

Step e will use flue pipe deviation information, specifically median of all flue pipe deviations saved in step d. Value of actual desired vibration frequency of the reed pipe is calculated by adjusting the stored value of desired vibration frequency of the reed pipe value by adding the median of flue pipe deviations obtained in step d. to the nearest note standard frequency of the stored desired vibration frequency of the reed pipe. Thus, obtained actual desired vibration frequency value of the reed pipe has the deviation from the nearest note standard frequency equal to the vibration frequency deviation of flue pipe(s) from the nearest standard frequency measured and calculated in step d. The actual desired vibration frequency value of the reed pipe will be the basis for engaging the actions to move the tuning wire described in step f (215).

Reed pipes are the pipes that need the most often tuning in a pipe organ. Flue pipes require significantly less tuning. Based on the method proposed by this invention, the tuning devices do not have to be installed on all the organ's pipes, but can only be installed on some of them, for example, only on the reed pipes or only on those reed pipes whose fundamental frequency is higher than 260 Hz.

If the flue pipe tuning devices with accelerometers and microcontrollers are installed in contact to more than two flue pipes, the flue pipe tuning devices can check through data communication whether the fundamental vibration frequency of flue pipes has changed evenly comparing the vibration frequency deviation of particular pipe and the median of all measured flue pipe deviations (217), identify the flue pipes whose vibration frequency has changed differently from other flue pipes and let the user know of the need to tune those pipes (218). Contrary, if all the flue pipes that are in contact with the flue pipe tuning device have sounded and the vibration frequency deviation from the nearest standard frequency of every flue pipe is less than 1 Cent different from the median of all flue pipe frequency deviations, organ flue pipes are in tune. Corresponding message will be sent to the operator. (This activity is not shown on the flowchart shown on the FIG. 7).

Sometimes windchest could carry neighbouring pipes vibration to the adjacent pipes and cause vibration that can be detected by accelerometer, even when the pipe is not sounding. However, the amplitude and frequency of such vibration are different from the amplitude and frequency of vibration that pipe itself produces when sounding. In the case that a small high pitch pipe is adjacent to a big low pitch pipe, such carried vibration from big pipe to small pipe could have even higher amplitude, than small pipe itself can produce, but its frequency is different. To avoid false determination of the vibration, the following steps are used.

In step b, together with the desired vibration frequency of the reed pipe also amplitudes of vibration in three axes are stored. In case there are one or more flue pipe tuning devices also the vibration frequency of the flue pipe and amplitude of vibration in three axes are stored (201, 204, 208). In addition to fundamental frequency of the reed or flue pipe, also vibration amplitudes in a few harmonic frequencies in three axes are stored.

In step d, after the detection of the vibration in the pipe, the tuning device measures its frequency and amplitude in three axes and the same number of harmonic frequency amplitudes as stored in step b. Thereafter the tuning device compares measurement results with the values stored in step b. The positive determination that the pipe is sounding is effected only in case the vibration frequency, and amplitudes of principal and certain higher harmonics are within predetermined range from the stored values (203, 212). In case the detected vibration does not fit into the predetermined range, vibration detection will be repeated as if there wasn't any vibration detected. The initial values for the previously mentioned range could, preferably, be: frequency not more than 50 Cent different from the stored value and amplitude not more than 20% different from the stored value. This predetermined range can vary on various tuning devices according to frequencies that could carry from adjacent pipes and could harm proper determination of the vibration and pipe sounding status. In such a case some specific range of the vibration amplitude and frequency used for determination of the vibration in the pipe is stored to the tuning device in step b.

In addition to the determination procedure described above, a computer learning (deep neural network) classification task could be used to automatically determine input data patterns (amplitudes of vibration in three axes and several harmonics of the spectrum), corresponding to actual or neighbor pipe sound. In this case neural network is trained in step b and obtained parameters are used in step d.

The currently disclosed pipe organ tuning method can be used during dedicated tuning procedure when user of the organ intentionally makes to sound the particular pipes for tuning purposes. The invention also allows automatically to tune the reed pipes of a pipe organ, unobtrusively to the user during regular playing. The user does not need to conduct the regular tuning procedure, during which single pipes are sounded only for the purpose of tuning so that simultaneously sounding pipes do not interfere with checking the tuning. Checking the tuning of flue pipes also takes place automatically during regular playing, without the need for the user to make single pipes sound only for the purpose of checking their tuning.

The tuning mechanism of the reed pipe tuning device can create sounds, that could be audible to the user if the general volume of the organ is low or absent. The method proposes to measure the general volume of the organ and only engage the automatic tuning mechanism of the reed pipe tuning device in step f if the general volume is sufficient for the sound created by the tuning mechanism to be unobtrusive to the user (219). The loudness can be measured with a separate microphone or by using the determined sounding status of pipes from the installed tuning devices.

Tuning System

Present invention offers a pipe organ tuning system, that comprises tuning devices, at least one or several reed pipe tuning devices 113, which in turn comprises an accelerometer 102 as a soundwave oscillation sensor, measuring the vibration of reed pipes 117, an electrically controlled reed pipe 117 tuning mechanism capable of moving the tuning wire 119 for changing the frequency of the reed pipes, and a microcontroller 104 with the capability to measure the vibration frequency from the accelerometer readings, to process the frequency readings, and control the reed pipe tuning mechanism. The reed pipe tuning device 113 is equipped with a fastener 109 that enables it to be attached to the tuning wire 119 of a reed pipe 117 in such a way that the of vibration from the reed pipe 117 is transmitted to the accelerometer 102. The accelerometer 102 is connected to the microcontroller 104, that performs the automatic tuning of reed pipe 117. The accelerometers 102 and tuning mechanisms, moving the tuning wire 119, attached to different reed pipes 117 can be connected to a single microcontroller 104 of a reed pipe tuning device 113.

The pipe organ tuning system can be implemented using various mechanisms of reed pipe tuning device 113 for purpose of moving the tuning wire 119; for example, a motor like the one described by EP3316249 A1 (Clemens Sulz, 2017) may be used. The present invention proposes an inertial armature 105 and anvils 110-111, attached to the reed pipe tuning wire 119 as the mechanism in the reed pipe tuning device 113. The above-mentioned inertial armature 105, which can rotate around the axis 110, is able to move the pitch-controlling tuning wire 119 and change the pitch of reed pipe 117 by knocking the above-mentioned anvils 110 and 111. One or several electromagnets 106-107 can be used as actuators for moving the inertial armature 105.

Flue Pipe Tuning Device

Most usual type of the pipe organ pipes is the flue pipes 116. The pipe organ tuning system can be used with the flue pipes 116, that cannot be automatically tuned with the flue pipe tuning device 112, as a part of the pipe organ tuning system. The flue pipe tuning device 112 is attached directly to the windchest 120 of the pipe organ or to the flue pipes support frame (not shown in the figures) that is attached to the windchest 120, so that the flue pipes 116 could be freely removed and replaced, for example, to perform manual tuning procedure. In order to carry vibration from the flue pipe 116 to the accelerometer 102 by touch contact, that creates mechanical connection between the accelerometer 102 and the flue pipe 116, whereas as the fastener for the flue pipe tuning device is used a leaf spring 111 or other similar means. The flue pipe tuning device 112 comprises at least one accelerometer 102, connected to the microcontroller 104. The microcontrollers 104 of the reed pipe tuning devise 113 or the flue pipe tuning devise 112 belonging to the tuning system are connected in network of data communication that allows them to exchange information about, for example, frequencies, temperature, humidity, etc. Removing flue pipes 116 freely means that when removing and replacing flue pipes 116 from windchest 120, the user does not need to go through the additional task of disconnecting and reconnecting or removing and reattaching the flue pipe tuning devices 112. The flue pipe tuning device fastener 111 is solved by means, for example, of leaf spring that attaches flue pipe tuning device to the windchest 120 and ensures sufficient touch contact to the flue pipe 116 that allows vibration frequency measurement. Such fastener 111 ensures that after reinstalling the flue pipe 116, the touch contact necessary to measure vibration will be restored. Fastener 111 allows freedom of movement in all three directions: parallel and perpendicular to the longitudinal axes of the flue pipe.

Reed Pipe Tuning Device

The invention offers a solution of the tuning mechanism used in the reed pipe tuning device 113, which can be used as a part of the tuning system described in the current invention, but can also be used separately. To move the tuning wire 119 with the reed pipe tuning device 113, the invention proposes the use of an inertial armature 105 and anvils 114, 115. There are many possibilities to move the inertial armature, one of them is to do it with electromagnets 106, 107 or single upper electromagnet 106 and the force of gravity and/or spring. The inertial armature 105 is accelerated with the upper 106 or lower 107 electromagnet and the momentum created by the impact with anvil 114 or 115 moves the tuning wire 119 that controls the pitch. The friction between the tuning wire 119 and the casing of a reed pipe 117 stops the tuning wire 119 from moving, when the inertial armature 105 picks up its speed, but the sudden impact against anvils 114-115 is enough to surpass this friction and to create movement.

The invention proposes using the inertial armature's position sensor 108, which could be implemented by infrared LED and a photo sensor, to more effectively control the movement of the inertial armature 105 by the electromagnets 106-107. The inertial armature's position sensor 108 is especially useful for reducing the drop speed of the inertial armature 105 after intentional knock against the upper anvil 114.

Different oscillation sensors can be used as vibration input for the above-mentioned reed pipe tuning device 113 with a moving inertial armature 105, for example, a microphone. Also, a semi-automatic tuning, where the reed pipe tuning device is controlled by an operator from a console connected to the reed pipe tuning device as described in patent application DE2622523A1 (Ernst Zacharias, 1976) can be implemented. According to the current invention preferred embodiment, the measuring of fundamental vibration frequency required for tuning of the reed pipe by the tuning device 113 is performed by the microcontroller 104 according to the vibration of the accelerometer 102, and the tuning of reed pipe 117 occurs automatically when the user sounds reed pipes during regular playing 117.

The microcontroller 104 in the reed pipe tuning device 113 uses the stored desired vibration frequency without any modification for tuning if the organ is located in a room with unchangeable temperature. However, organs are often installed in churches, where the room temperature fluctuates. It is proposed that the device 113 comprises a room temperature and humidity sensor 103 in addition to the accelerometer 102. Thus, the microcontroller 104 can be used to actualize, by means of calculating, as the function of the stored desired vibration frequency and the environmental sensor values, the desired vibration frequency, and so, when the room temperature and humidity are changed, to achieve consonance with the flue pipes 116 of the pipe organ, whose pitch changes based on the room temperature and humidity.

LIST OF FIGURES

FIG. 1 shows the tuning system of a pipe organ according to the first example, where the reed pipe tuning devices 113 have been attached to reed pipes 117.

FIG. 2 shows the tuning system of a pipe organ according to the second example, where three flue pipe 116 stops and one reed pipe 117 stop have been equipped with flue pipe tuning devices 112 and reed pipe tuning devices 113, accordingly.

FIG. 3 shows the reed pipe tuning device 113 according to the first example, where the reed pipe tuning device 113 along with the upper electromagnet 106 and the lower electromagnet 107 has been attached to the tuning wire 119 of a reed pipe 117.

FIG. 4 shows the reed pipe tuning device 113 according to the second example, where the reed pipe tuning device 113 is attached to the tuning wire 119 of a reed pipe 117.

Figure 1:
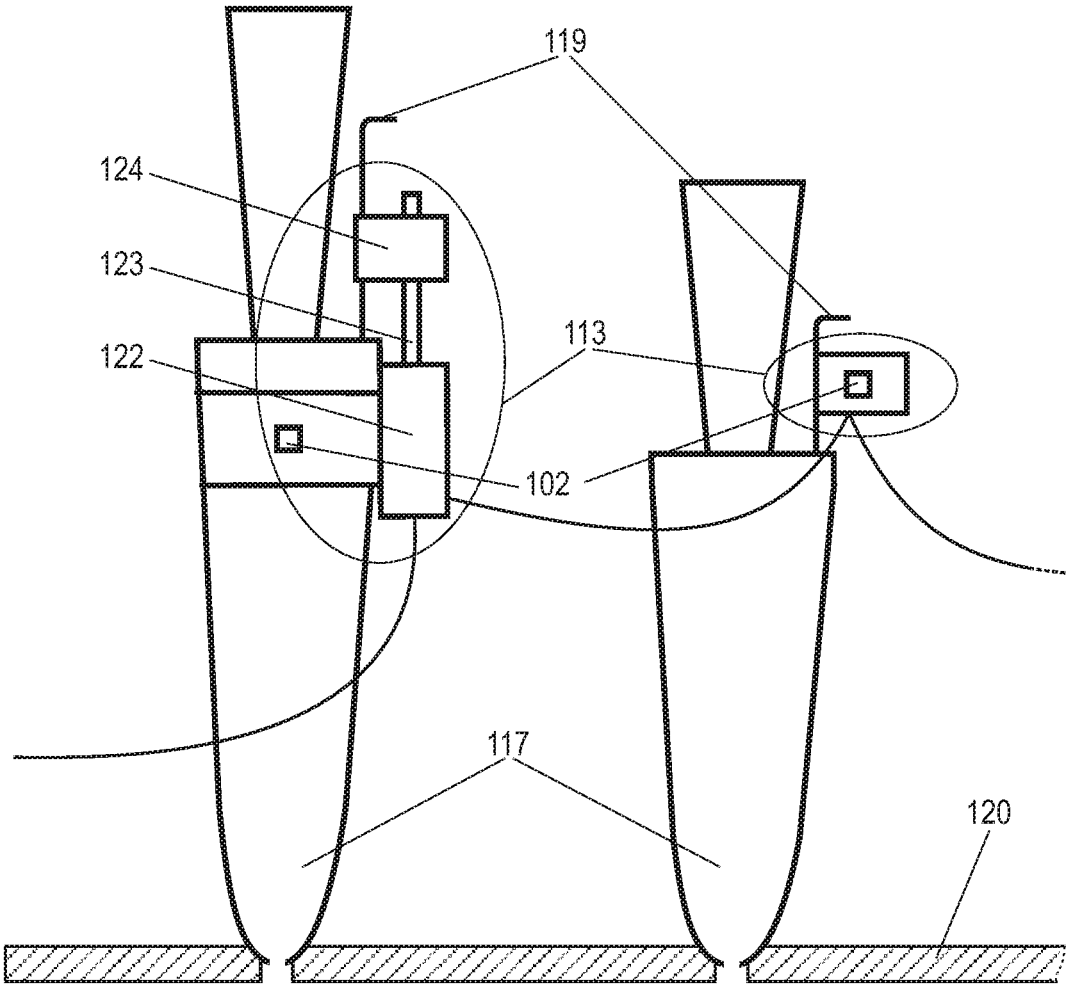

LIST OF THE REFERENCES OF FIGURES 101 base plate of the tuning device
102 accelerometer
103 temperature and humidity sensor
104 microcontroller
105 inertial armature
106 upper electromagnet
107 lower electromagnet
108 position sensor of the inertial armature
109 fastener
110 axis of the inertial armature
111 fastener of the flue pipe tuning device
112 flue pipe tuning device
113 reed pipe tuning device
114 upper anvil
115 lower anvil
116 flue pipe
117 reed pipe
118 vibrating part of the reed pipe's tongue
119 tuning wire
120 windchest
121 spring
122 motor
123 threaded spindle
124 adapter with spindle nut
Steps 200-221 on the flowcharts are illustrating the method of the current invention.

PREFERRED EMBODIMENTS

The First Example

Figure 5:
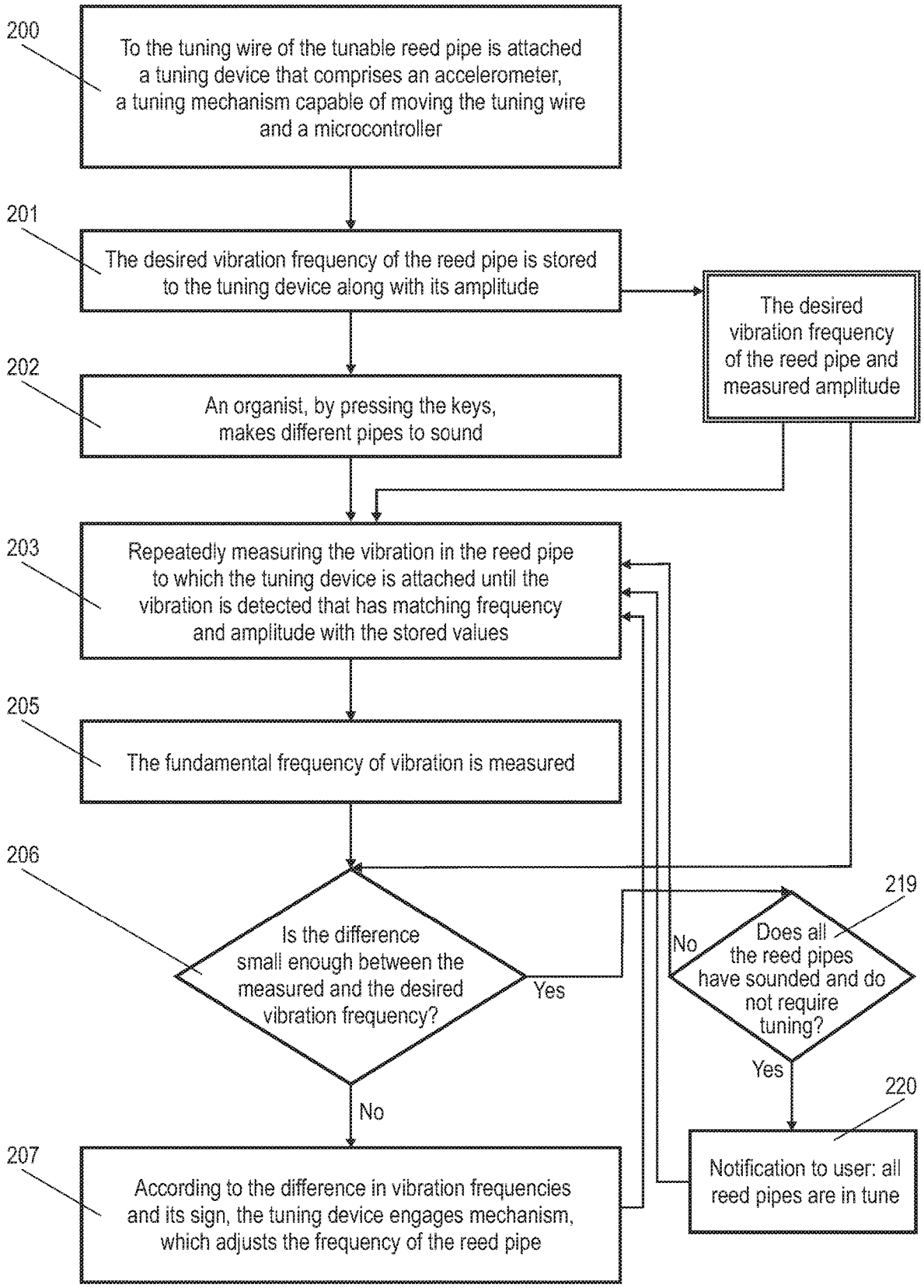
FIG. 5 shows the method flowchart according to the first example.

This example describes the tuning of pipe organ that is located in a room with fixed temperature, which means that the room temperature does not change by more than 0.5 centigrade all year round and the pitch of flue pipes 116 remains persistent. Reed pipes 117 need more or less frequent tuning.

a) The pipe organ tuning system (FIG. 1) comprises the reed pipe tuning devices 113 attached to the reed pipes 117 of a single reed pipe stop of the pipe organ (200, FIG. 5). Depending on the construction peculiarities of the reed pipes 117, different tuning mechanisms can be used on the reed pipe tuning devices 113 to move the tuning wire 119: tuning mechanisms with a motor or tuning mechanisms with an inertial armature. All reed pipe tuning devices 113 comprise the accelerometer 102, connected to microcontroller 104.

The reed pipe 117 tuning wire 119 moving mechanism with a motor 122 has threaded spindle 123, that is attached to the motor 122 shaft and the spindle nut attached with adapter 124 to tuning wire 119. This tuning mechanism is used in some reed pipe tuning devices 113.

Figure 3:
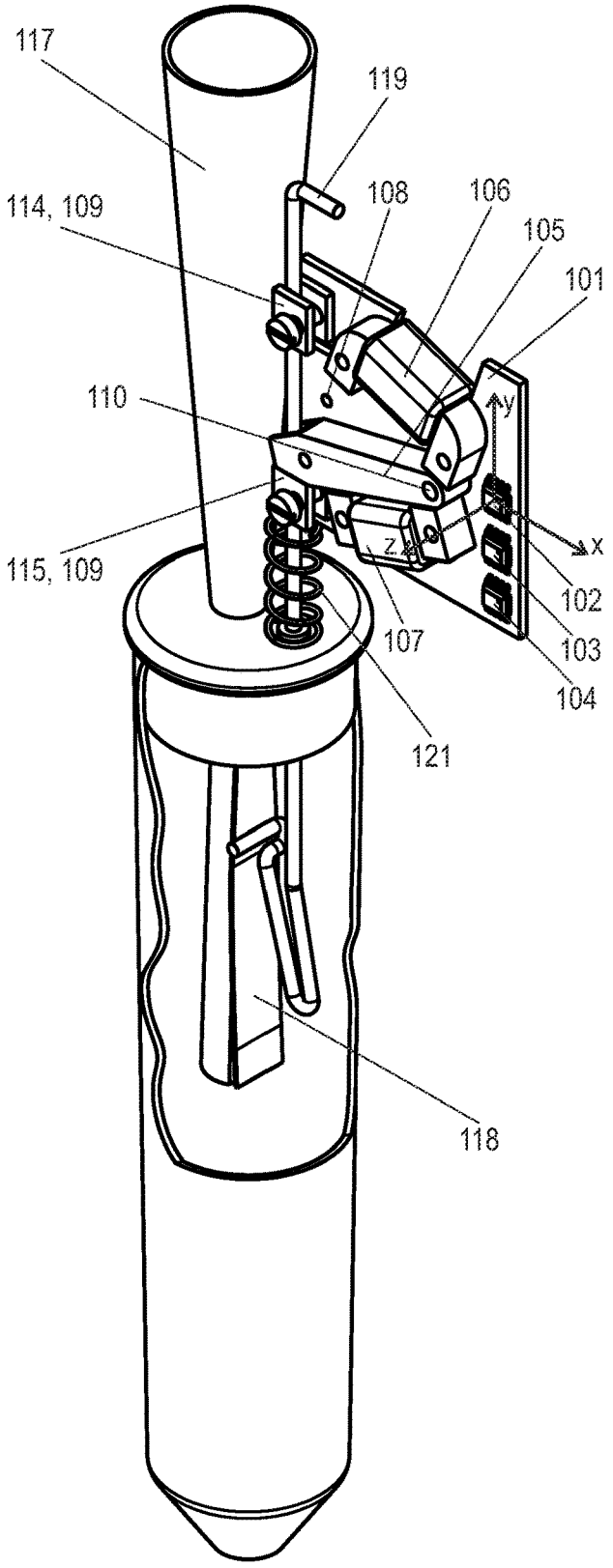

The reed pipe tuning device 113 with tuning wire 119 moving mechanism, that uses an inertial armature, is shown on FIG. 3. It comprises the base plate 101, which forms the base for installing the accelerometer 102, microcontroller 104 and other electronic components. The inertial armature 105, capable of turning around the axis 110, is installed on the base plate 101. The microcontroller 104 is connected by corresponding power circuits (not shown on the figure) to the electromagnets 106, 107 mounted on the base plate 101.

The base plate 101 is attached to the tuning wire 119 of the reed pipe 117 with fasteners 109, which serve also as the anvils 114, 115. A spring 121 installed between the reed pipe tuning device 113 and the casing of the reed pipe 117 is compressed during installation to such an extent that the compressing force would roughly be equal to the weight of the reed pipe tuning device 113. The reed pipe tuning device 113 is connected to electric power supply (not shown on the figure). The tuning wire 119 which determines the length of the vibrating part of the reed pipe's 117 tongue 118 is fixed in the casing of the reed pipe by friction and can be moved up or down if the moving force overcomes the friction.

Figure 4:
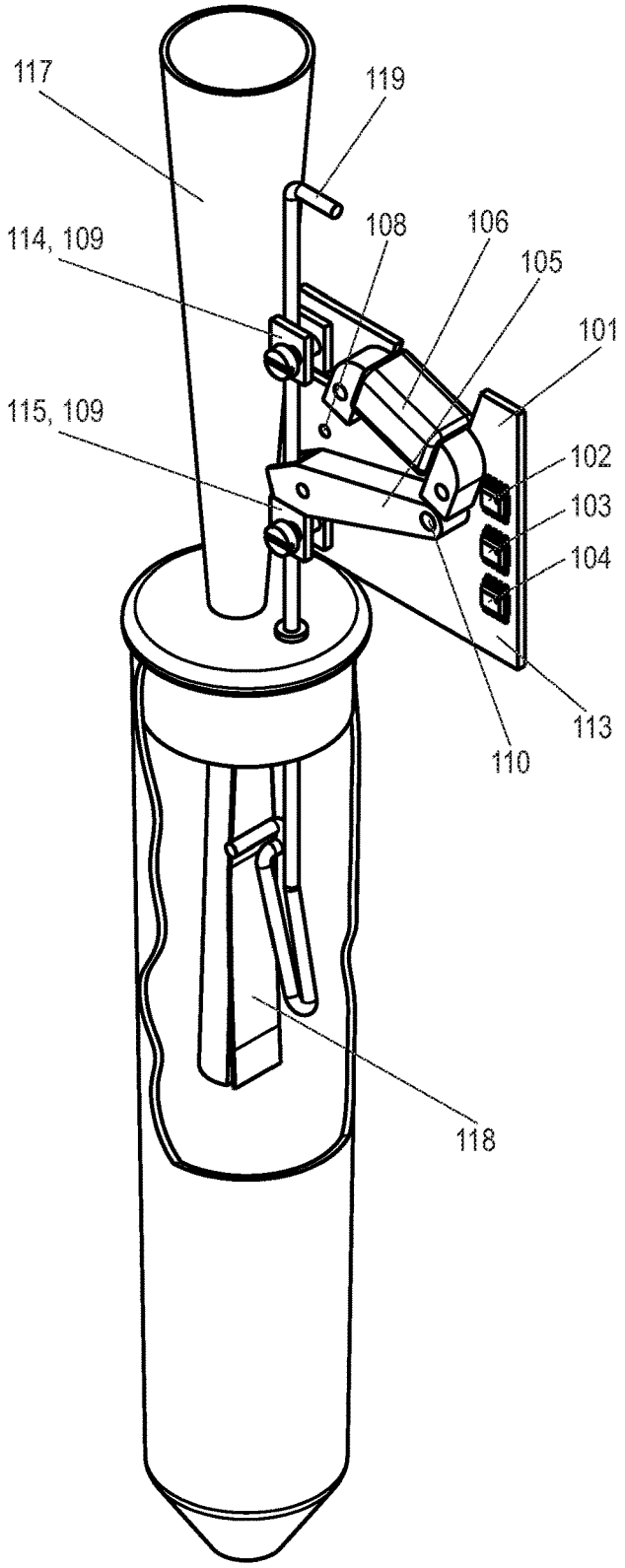

With smaller pipes, where less force Is required to move the turning wire 119, the reed pipe tuning device 113 with only upper electromagnet 106 is used (FIG. 4).

b) The reed pipe tuning devices 113 are set up by making the selected pipes, that previously have been manually tuned, to sound, measuring their vibration and storing the desired vibration frequency and amplitude of the vibration of the reed pipes 117, to which they are attached. During the setup the vibration frequency is measured in three axes and on each axis the amplitudes of the three lowest vibration frequency harmonics are measured and stored. Said 9 amplitudes are stored for use in determination of the sounding status of the pipe (201).

c) An organist starts to play the organ regularly, making different flue pipes 116 and reed pipes 117 to sound (202).

d) The following actions are performed automatically during the playing of the organ. By using the microcontroller 104 and the accelerometer 102, each of the reed pipe tuning devices 113 detect whether there is any vibration in the reed pipes 117 to which the corresponding tuning devices 113 is attached (203), that has fundamental frequency not more than 50 Cent different from the desired vibration frequency stored in step b and at least three amplitudes out of measured 9 that are not more than 20% different from amplitudes of the vibration stored in step b. If there is no matching vibration in the particular reed pipe 117, the reed pipe tuning device 113 continues to wait until the vibration will be detected in the particular reed pipe 117 that matches the above criteria.

e) After the vibration, meeting the amplitude and frequency criteria described in step d, is detected in a particular reed pipe 117, the microcontroller 104 measures the vibration frequency of that reed pipe by using the Fourier transform (205), and if the difference with the desired vibration frequency stored to the device is more than one Cent, the microcontroller 104 engages the tuning mechanism (207), which move the tuning wire 119 of the particular reed pipe 117 in the required direction (up or down), changing the pitch of the reed pipe 117.

Reed pipe tuning device 113 mechanism equipped with motor uses electrical impulses for it control.

Reed pipe tuning device 113, that has the mechanism equipped with inertial armature 105 performs as following:

1) Based on the difference between measured vibration and desired vibration frequencies, the microcontroller 104 calculates the required moving direction of the tuning wire 119, the impact force and the number of impacts.
2) To tune the reed pipe 117 to a lower pitch, the tuning wire 119 must be moved upwards. For that purpose, the upper electromagnet 106 is given an electrical impulse with appropriate length, which makes the inertial armature 105 to move towards the upper anvil 114 and make an impact to it.
3) The microcontroller 105 uses the position sensor 108 of the inertial armature 105 to control the movement of the inertial armature 105.
4) The force of impact of the inertial armature 105 to the upper anvil 114 moves the tuning wire 119 upwards.
5) After the electromagnet turns off, under the force of gravity the inertial armature 105 starts to fall back to its initial position, towards the lower anvil 115.
6) At the appropriate moment, by using the data from the position sensor 108 of the inertial armature, the microcontroller 104 engages a feedback mechanism between the position sensor 108 and the upper electromagnet 106, that lowers the inertial armature 105 gradually without any significant impact up to the lower anvil 115.
7) To tune the reed pipe 117 to a higher pitch, the tuning wire 119 needs to be moved downwards. For that purpose, the upper electromagnet 106 is given a shorter impulse, that makes the inertial armature 105 to move towards the upper anvil 114, but with no impact to it.
8) After the inertial armature 105 reaches the highest point of its movement, as detected by the position sensor 108, the microcontroller 104 gives an electrical impulse to the lower electromagnet 107, forcing the armature 105 to move downwards and make an impact to the lower anvil 115.
9) The force of the impact of the inertial armature 105 to the lower anvil 115 moves the tuning wire 119 downwards.

The reed pipe tuning device 113 that has only upper electromagnet 106 (FIG. 4) performs the impact on the lower anvil for moving the tuning wire 119 downwards using the momentum that the inertial armature 105 gets from gravity.

The tuning steps d-e for all reed pipes 117 are performed automatically during the playing of the organ.

The Second Example

The second example describes tuning of the pipe organ located in a church hall that is warmer during summer (up to 25° C.) and colder during winter (18° C.). Due to the fluctuation of the room temperature, the average pitch of the flue pipes changes and the reed pipes need retuning according to the changed pitch of the flue pipes. In addition, the reed pipes also need tuning due to random getting out of tune during winter, when the church hall is heated to maintain the temperature of 18° C.

The pipe organ tuning system similar to the first example, comprising the reed pipe tuning devices 113, is used. In addition to the equipment, described in first example, the reed pipe tuning devices 113 include a temperature and humidity sensor 103.

Figure 6:
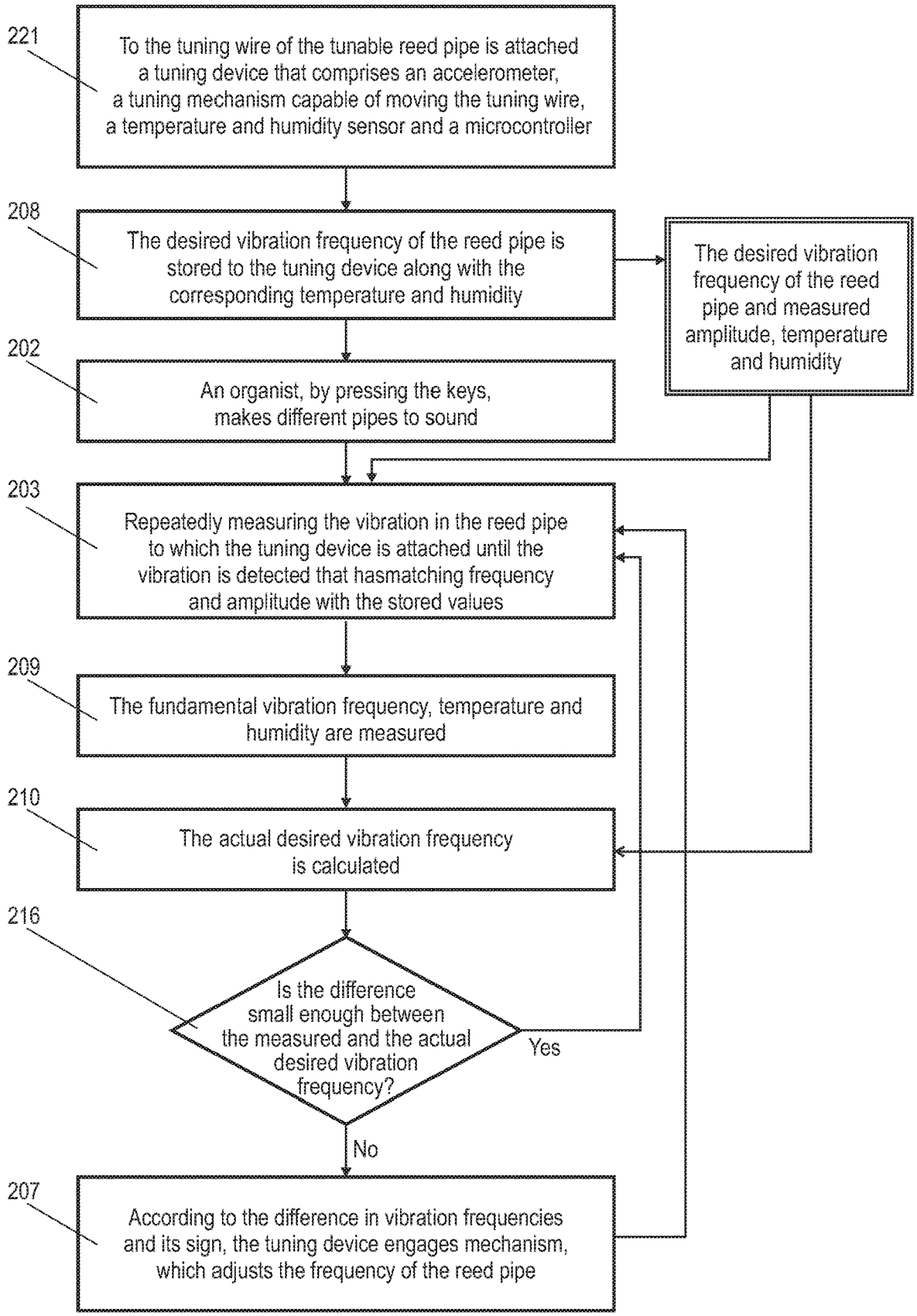
FIG. 6 shows the method flowchart according to the second example.

According to the method proposed by the invention, the following actions are taken (FIG. 6):

a) Reed pipe tuning devices 113, comprising an accelerometer 102, and temperature and humidity sensor 103 connected to a microcontroller 104, a tuning mechanism comprising inertial armature 105 and anvils 114, 115, which allows microcontroller 104 to move the tuning wire 119, are attached to the tuning wires 119 of all the reed pipes 117 of a single reed pipe 117 stop (221).
b) The reed pipe tuning device 113 is set up by saving the desired vibration frequency of each reed pipe 117 (201), whereas the amplitude of the vibration, and the room temperature and humidity corresponding to the stored desired vibration frequency of the reed pipe 117 are also stored.

c) Organist starts to play the organ regularly, making different flue pipes 116 and reed pipes 117 to sound (202).

d) By using the microcontroller 104 and the accelerometer 102, the reed pipe tuning devices 113 detect whether there is any vibration in the reed pipe 117, to which the corresponding tuning device 113 is attached (203). If there is no vibration in the reed pipe 117, it continues to detect until there will be the vibration that has the frequency not more than 50 Cent different from the vibration frequency stored in step b and the amplitude not more than 20% different from vibration amplitude stored in step b.

e) Once there has appeared sufficient vibration in any of the reed pipes 117, the microcontroller 104 is used to measure the vibration frequency of this reed pipe 117, together with the actual temperature and humidity (209).

f) The actual desired vibration frequency of the reed pipe 117 is calculated as a function of the desired vibration frequency of the reed pipe 117, and actual temperature and humidity by using the following formula:

$$f = f_0 \times 2^{\left(\frac{(t-t_0)\times 2.9+(RH-RH_0)\times 0.06}{1200}\right)}$$

f—actual desired vibration frequency of the reed pipe, $f_0$—original desired vibration frequency of the reed pipe, t—actual room temperature, $t_0$—room temperature during the set-up of the reed pipe tuning device, RH—actual relative humidity in percentages, $RH_0$—relative humidity in percentages during the set-up of the reed pipe tuning device g) The microcontroller 104 is used to compare the measured reed pipe 117 vibration frequency against the actual desired vibration frequency (216) and in the case of a difference (at least 1 Cent), the microcontroller engages the tuning mechanism of the reed pipe 117 (207), which moves the tuning wire 119 in the required direction (up or down), changing the pitch of the reed pipe. Moving of tuning wire 119 takes place as described in the first example.

The Third Example

The third example, similarly to the second one, describes tuning of the pipe organ located in a church hall that is warmer during summer (up to 25 degrees Celsius) and colder during winter (about 18 degrees Celsius). Additionally to the reed pipes that need more frequent tuning, the user of the organ may wish to automatically check the tuning of flue pipes and to receive current information about the loss of their tuning.

Figure 2:
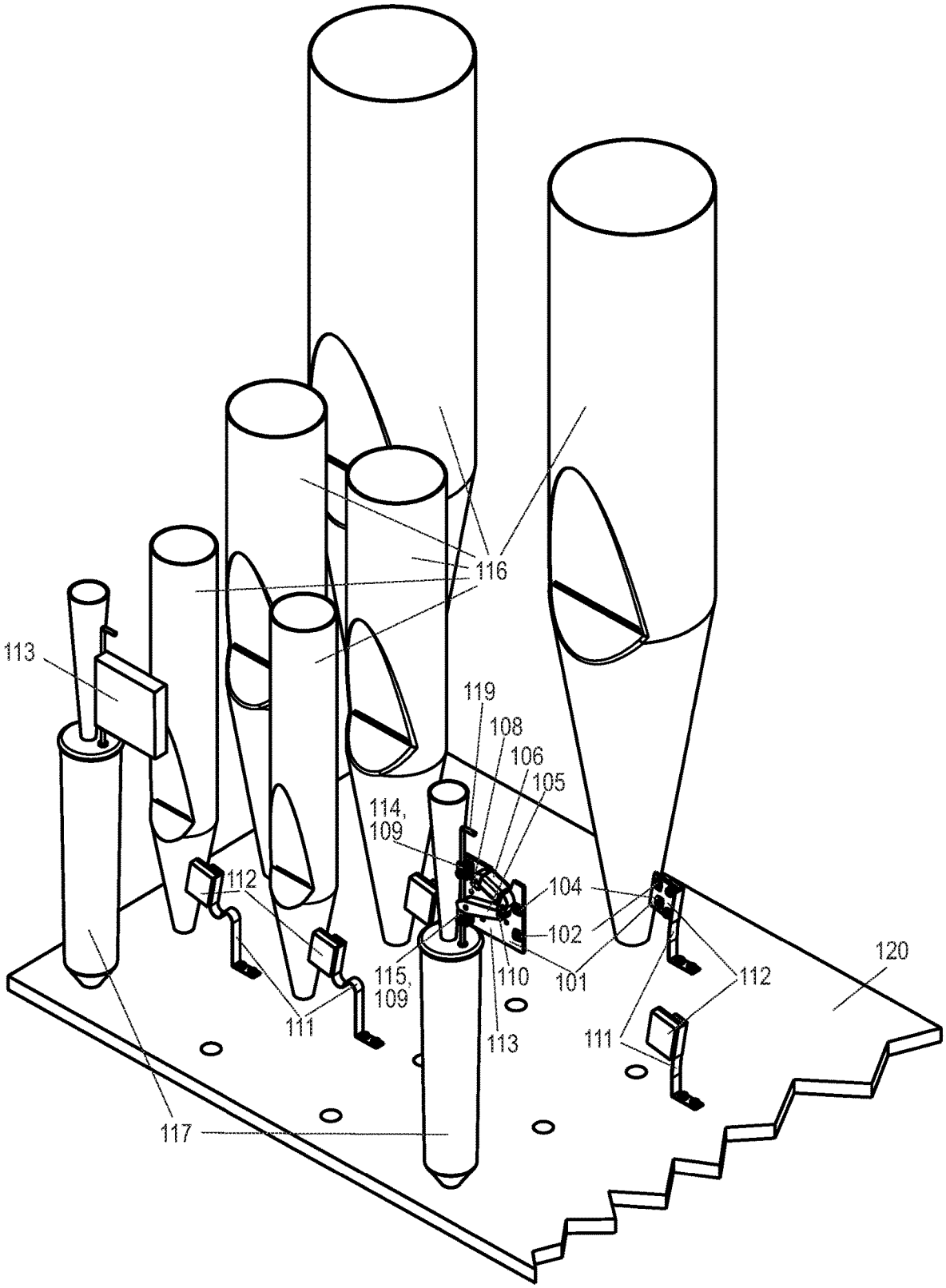
Figure 7:
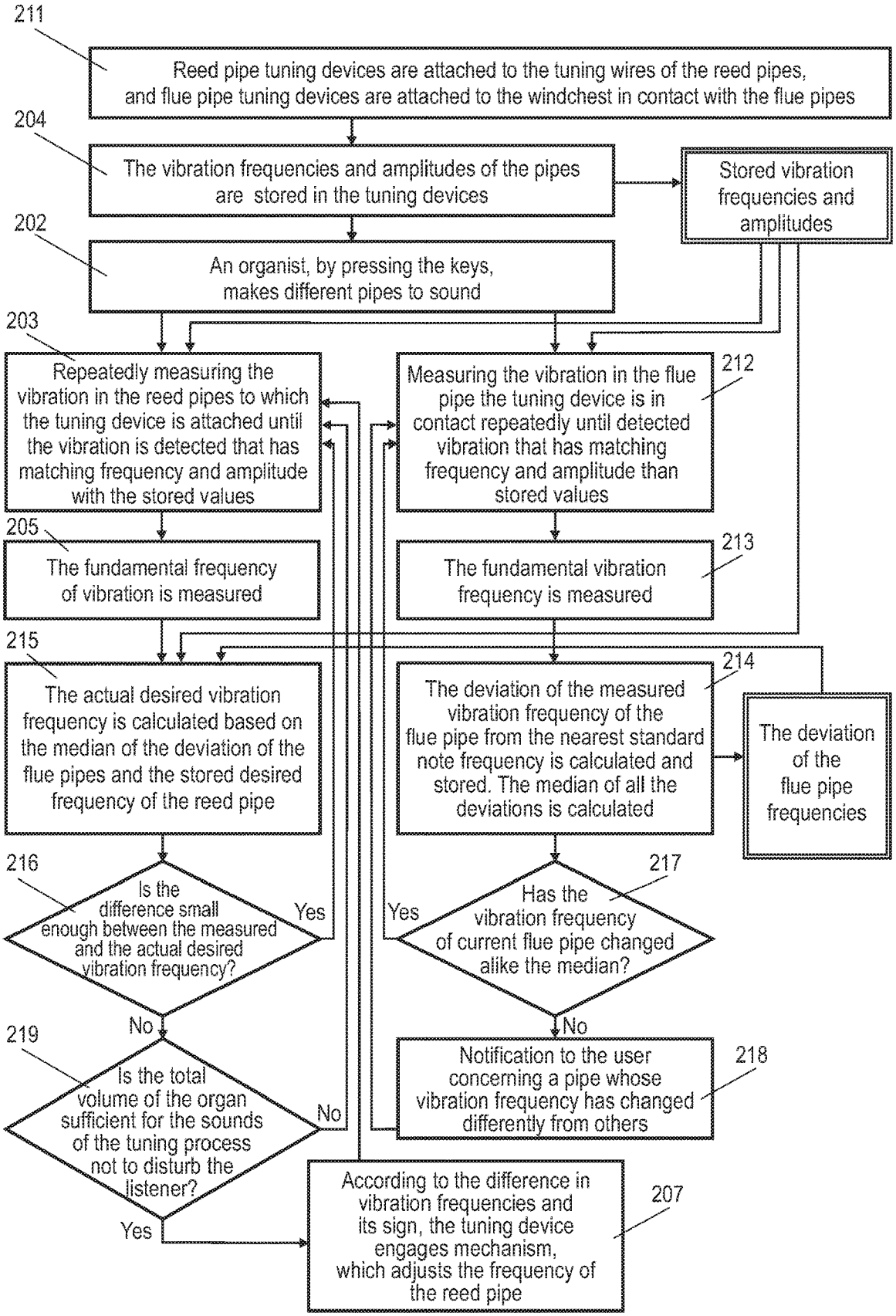
FIG. 7 shows the method flowchart according to the third example.

The pipe organ tuning system, comprising the flue pipe tuning devices 112 and the reed pipe tuning devices 113, is used (FIG. 2). The following actions are taken to tune the pipe organ (FIG. 7):

a) The tuning system of the pipe organ is installed so that flue pipe tuning devices 112 are in contact with all of the flue pipes 116 and the reed pipe tuning devices 113 are attached to the tuning wires 119 of all the reed pipes 117 (211). All tuning devices include an accelerometer 102, connected to a microcontroller 104. In the case of the reed pipes 117, the reed pipe tuning devices 113 include the tuning mechanism comprising inertial armature 105, anvils 114, 115, and electromagnets 106, 107, which allow the microcontroller 104 to move the tuning wire 119. The flue pipe tuning device 112 (FIG. 2) comprises a base plate 101, which forms a base for the installation of the accelerometer 102, microcontroller 104, and other electronic components. The base plate is attached on the windchest 120 with a leaf spring 111. Leaf springs 111 are configured to be compatible with the flue pipe 116 to which it is meant to be attached and to allow the movement of the flue pipe tuning device 112, as minimum, in the direction, parallel to the longitudinal axis of the flue pipe 116, but preferably in all three directions. The flue pipe tuning device 112 is connected to electric power and data network (not shown on the figure).

b) The reed pipe tuning devices 113 are set up by saving the desired vibration frequency of the reed pipe 117 and the amplitude of the vibration, as it was described in the first example. Similarly, the flue pipe tuning devices 112 are set up by saving the desired vibration frequency of the flue pipe 116 and the amplitude of the vibration (204).

c) An organist starts to play the organ normally, making different flue pipes 116 and reed pipes 117 sound (202).

d) By using the microcontroller 104 and the accelerometer 102, the flue pipe tuning devices 112 detect if there is any vibration in the flue pipe 116 with which the corresponding tuning device 112 is in contact (212). All the flue pipe tuning devices 112 that have not determine the existence of vibration will continue to wait for it by repeating the step d until the sufficient vibration has appeared. In case the sufficient vibration is determined, its frequency and amplitude are measured by using the accelerometer 102 and microcontroller 104. Measurement results are compared to vibration frequency and amplitude values stored about this pipe in step b and in case the difference in frequency is not more than 20 Cents and amplitude not more than 20% different, the vibration positive detection is fixed. In case detected vibration amplitude or frequency difference from stored values is higher than the predetermined range, the waiting of the vibration continues by repeating the detection as stated in the beginning of this step.

e) Once there appears a vibration, the vibration fundamental frequency of the flue pipe 116 is measured (213) and used to calculate the relative frequency deviation from the nearest note of standard frequency. The deviations of flue pipe 116 vibration fundamental frequencies are saved to a database, and based on those deviations in the database, the median of the deviations of vibration frequencies is calculated (214).

f) Every deviation of the vibration frequency of the flue pipe 116 is compared to the median of all the deviations of the flue pipes 116. The user receives information concerning every flue pipe 116 whose vibration frequency's deviation from the median of all the deviations of flue pipes 116 is higher than 1 Cent (217).

g) By using the microcontroller 104 and the accelerometer 102, the reed pipe tuning devices 113 detect whether there is vibration in the reed pipe 117 to which the corresponding tuning device 113 is attached (203). Every reed pipe tuning device 113 that do not detect vibration in the reed pipe 117 to which it is attached, continues to repeat step g. In case the vibration is detected its frequency and amplitude are measured using the accelerometer 102 and microcontroller 104. Measurement results are compared to reed pipe desired vibration frequency and amplitude values stored about this pipe in step b and in case the difference in frequency was not more than 50 Cents and amplitude not more than 20 percent different the vibration positive detection is fixed. In case detected vibration amplitude or frequency difference from stored values is higher than the predetermined range, the waiting for the vibration will continue by repeating the detecting as stated in the beginning of this step.

h) If there is a positively detected vibration in any reed pipe 117, the microcontroller 104 is used to measure the vibration frequency of that reed pipe (205).

i) The desired vibration frequency of the reed pipe 117 is adjusted accordingly to get the actual desired frequency value, so that its deviation from the nearest standard frequency would be equal to the flue pipes vibration deviation median from the nearest standard frequency calculated in step e (215).

j) The following actions are taken based on the actual desired frequency value of reed pipes 117. The microcontroller 104 is used to compare the measured vibration frequency of a reed pipe 117 against the actual desired vibration frequency of the reed pipe 117 (216) and in the case of a difference (at least 1 Cent), the microcontroller engages the tuning mechanism (207), which move the tuning wire 119 of the reed pipe 117 in the required direction (up or down), changing the vibration frequency of the reed pipe 117.

The tuning steps d-g are automatically performed during the regular playing of the organ, constantly repeating steps c-g. The microcontroller 104 decides, based on the volume of the organ, whether to perform the tuning actions, that may create some audible sound, or to postpone them until the general sound volume of the organ is sufficient to mask them from the listener (219).

INDUSTRIAL APPLICABILITY

The pipe organ tuning system and pipe organ tuning devices of all the embodiments can be industrially produced and installed on the pipe organ permanently. Following installation and saving the desired vibration frequency, the pipe organ tuning system or the pipe organ tuning devices are capable of working autonomously, only requiring an electric power supply. To use the advanced features, the device may communicate with other devices belonging to the network, the central device or mobile phone.

The invention claimed is:

1. A method for tuning a pipe organ, which comprises the following steps, performed at least on one reed pipe of the organ:

a) attaching a reed pipe tuning device (113) to a reed pipe (117) of an organ, the reed pipe tuning device (113) comprising an accelerometer (102), a microcontroller (104) and a tuning mechanism configured to move a tuning wire (119) of the reed pipe (117);

b) storing a value of a desired vibration frequency of the reed pipe (117) in the microcontroller (104) of the reed pipe tuning device (113);

c) making different pipes of the pipe organ sound by a user of the pipe organ;

d) by using the accelerometer (102) and the microcontroller (104) of the reed pipe tuning device (113), repeatedly measuring vibration in the reed pipe (117) to which the tuning device (113) is attached and comparing measured amplitudes of frequency components corresponding to the stored vibration frequency with the stored amplitude, until a vibration that has matching amplitude along at least one axis is detected, and measuring the fundamental frequency of the detected vibration;

e) based on the difference between the value of the measured vibration frequency of the reed pipe (117) and the value of the desired vibration frequency, controlling the abovementioned tuning mechanism, and adjusting the vibration frequency of the reed pipe (117) to be equal to the value of the desired vibration frequency by moving the tuning wire (119), whereas the tuning mechanism comprises an inertial armature (105), on which at least one electromagnet (106, 107) and two anvils (114, 115) are mounted, the two anvils being attached on different parts of the tuning wire (119) of the reed pipe (117), wherein the inertial armature (105) is configured to move the tuning wire (119) for controlling the vibration frequency of the reed pipe (117) by selectively knocking one of the two anvils (114, 115).

2. The method according to claim 1, where the following additional actions are taken in steps b and e:

in step b, storing an actual temperature and/or humidity values together with the value of the desired vibration frequency of the reed pipe (117), in step e, measuring a room temperature and/or humidity, and calculating, as a function of the stored desired vibration frequency of the reed pipe (117) and of the change of room temperature and/or humidity, an actual desired vibration frequency to be used as the value of the desired vibration frequency in step e.

3. The method according to claim 1, which includes the following additional actions in steps a, d, and e:

a) installing at least one flue pipe tuning device (112), on at least one flue pipe (116) of the pipe organ, the flue pipe tuning device (112) comprising an accelerometer (102) and microcontroller (104), whereas said flue pipe tuning device (112) is configured to exchange information with at least one reed pipe tuning device (113), and is in touch contact with flue pipe (116) of the pipe organ;

b) storing a value of a desired vibration frequency and amplitude of the flue pipe (116) in the microcontroller (104) of the flue pipe tuning device (112);

d) by using the accelerometer (102) and the microcontroller (104) of the flue pipe tuning device (112), repeatedly measuring vibration in the flue pipe (116), which is in touch contact with aforesaid at least one flue pipe tuning device (112), comparing measured amplitudes of frequency components corresponding to the stored frequency with the stored amplitude for the flue pipe (116), until a vibration that has matching amplitude along at least one axis is detected, measuring the value of the detected vibration frequency of the flue pipe (116) and calculating a deviation of the detected flue pipe (116) vibration frequency from the nearest note standard frequency;

e) before the actions described in step e of claim 1, calculating an actual desired vibration frequency value of the reed pipe by adjusting the value of the stored desired vibration frequency of the reed pipe (117) to make its deviation from the nearest note standard frequency equal to the vibration frequency deviation of flue pipe(s) (116) from the nearest note standard frequency measured and calculated in step d, and using the actual desired vibration frequency value of the reed pipe (117) as the basis for the actions described in step e of claim 1.

4. The method according to claim 3, which includes the following additional actions in steps a and d:

a) additionally installing three or more flue pipe tuning devices (112), each comprising a microcontroller (104) and an accelerometer (102) connected to the microcontroller (104), in touch connection with corresponding three or more flue pipes (116) of the organ;

d) after checking the tuning of each of flue pipes (116) based on the vibration frequencies measured by each of the accelerometer (102) and of the microcontroller (104), and based on a distribution of vibration frequencies, notifying an operator of the need or no need to tune some of the flue pipes (116).

5. The method according to claim 1, where the following additional actions are taken in steps b and d:

in step b, storing multiple of amplitudes of harmonics in the spectrum of vibration of the reed pipe (117) along one or several axes and in case there is at least one flue pipe tuning device (112) attached to the organ, the vibration frequency and multiple of amplitudes of harmonics in the spectrum of vibration of the at least one flue pipe (116) in one or several axes together with the desired vibration frequency of the reed pipe (117), and in step d, in the detection of the matching vibration in the reed pipe (117) or flue pipe (116), measuring of multiple amplitudes of harmonics in the spectrum of vibration in the one or several axes, comparing the measurement results with the values stored in step b and establishing the detection of vibration only in case if more than one of the measured vibration frequency and/or amplitude are within predetermined range from the stored values.

6. The method according to claim 1, wherein said steps d-e are performed automatically during the playing of the pipe organ.

7. The method according to claim 6, wherein sound-producing tuning actions in step e are performed or postponed by the microcontroller (104) based on the general volume produced by the pipe organ.

8. A pipe organ reed pipe tuning device (113), which includes:

at least one soundwave oscillation sensor (102);

a reed pipe tuning mechanism comprising at least an actuator; and a microcontroller (104), configured to control the reed pipe tuning mechanism and connected to the at least one soundwave oscillation sensor (102), wherein said reed pipe tuning mechanism further comprises an inertial armature (105), on which the at least one actuator (106, 107) and two anvils (114, 115) are mounted, the two anvils being attached on different parts of the tuning wire (119) of the reed pipe (117).

9. The device according to claim 8, wherein said inertial armature (105) is configured to move the tuning wire (119) for controlling the vibration frequency of the reed pipe (117) by selectively knocking one of the two anvils (114, 115).

10. The device according to claim 8, wherein the at least one actuators are one or several electromagnets (106, 107).

11. The device according to claim 8, wherein the at least one soundwave oscillation sensor is an accelerometer (103), configured to measure the vibration of the reed pipe.

12. The device according to claim 8, wherein the reed pipe tuning device (113) is configured to determine if the reed pipe (117) to which it is attached is sounding.

13. The device according to claim 8, wherein it further comprises a room temperature and/or humidity sensor (103) attached to the microcontroller (104) and configured to actualize the value of desired vibration frequency based on the measured room temperature and/or humidity.

* * * * *